US005221183A

United States Patent [19]

Hoeffken

[11] Patent Number: 5,221,183

[45] Date of Patent: Jun. 22, 1993

[54] BLOWER HOUSING SEAM AND METHOD OF MAKING SAME

[75] Inventor: Russell W. Hoeffken, Belleville, Ill.

[73] Assignee: Alco Industries, Inc., Valley Forge, Pa.

[21] Appl. No.: 850,863

[22] Filed: Mar. 13, 1992

[51] Int. Cl.[5] ..... F04D 29/40

[52] U.S. Cl. ..... 415/215.1; 29/509

[58] Field of Search ..... 415/203, 214.1, 215.1; 29/509, 521, 888

[56] References Cited

U.S. PATENT DOCUMENTS

| | | | |
|---|---|---|---|
| 3,138,107 | 6/1964 | Zeidler | 415/215.1 |
| 3,405,439 | 10/1968 | Uemura | 29/509 |
| 3,548,564 | 12/1970 | Bruce et al. | 29/509 |
| 3,743,439 | 7/1973 | Cann | 415/215.1 |
| 3,909,918 | 10/1975 | Takizawa et al. | 29/509 |
| 4,131,980 | 1/1979 | Zinnbauer | 29/509 |
| 4,481,978 | 11/1984 | Escandell | 29/509 |
| 4,697,972 | 10/1987 | Le Bret et al. | 29/509 |
| B14,697,972 | 4/1991 | Le Bret et al. | 29/509 |
| 4,888,919 | 12/1989 | Strosberg et al. | 29/509 |

FOREIGN PATENT DOCUMENTS 0403007 12/1990 European Pat. Off. ..... 415/215.1

*Primary Examiner*—Edward K. Look
*Assistant Examiner*—Michael S. Lee
*Attorney, Agent, or Firm*—Rogers, Howell & Haferkamp

[57] ABSTRACT

An improved blower housing is constructed of a pair of end walls and a sidewall joined by a seam extending around at least portions of the peripheral edges of the end walls, wherein the seam is formed in two sections positioned at an angle relative to each other, the angle dividing the seam sections extending around the seam. The angle formed between the two seam sections improves the ability of the seam to resist relative movement between the sidewall and the two end walls of the blower housing due to vibrations of the sidewall and two end walls during blower operations. The seam also enables a blower housing to be constructed from a coated sidewall and a pair of coated end walls without the need for spot welds or screws along the seam joining the sidewall and end walls. What is meant by coated is a prepainted, galvanized or aluminized wall. The particular seam construction also enables the sidewall to be joined to the pair of end walls without deforming the end walls.

28 Claims, 2 Drawing Sheets

BLOWER HOUSING SEAM AND METHOD OF MAKING SAME

BACKGROUND OF THE INVENTION (1) Field of the Invention

The present invention pertains to a blower housing for a blower fan of a heating furnace or other similar types of blower applications. In particular, the present invention pertains to a blower housing constructed of a pair of end walls and a sidewall joined by seams extending around at least portions of the peripheral edges of the end walls, wherein the seams are formed in two sections positioned at angles relative to each other, the angles dividing the seam sections extending around the seams. The angles formed between the two seam sections improves the ability of the seams to resist relative movement between the sidewall and the two end walls of the blower housing due to vibrations of the sidewall and two end walls during blower operations. The seams also enable a blower housing to be constructed from a coated sidewall and a pair of coated end walls without the need for spot welds or screws along the seams joining the sidewall and end walls. What is meant by coated is a prepainted or precoated sidewall or end walls such as galvanized or aluminized walls. The particular seam construction also enables the sidewall to be joined to the pair of end walls without deforming the end walls.

(2) Description of the Related Art

Blower housings of the type pertaining to the present invention are typically employed in forced air heating furnaces. In most cases, the blower is assembled in the interior of the furnace. Ambient air is blown by the blower over heat exchangers that heat the air passed over the exchangers by the blower. The heated air is then forced from the furnace by the blower.

A typical blower housing contains a cylindrical blower fan and is constructed from a pair of housing end walls spaced at opposite lateral sides of the blower housing, and a sidewall that is connected around peripheral edges of the two end walls. The sidewall spaces the two end walls laterally from each other, and gives the blower housing a general cylindrical configuration well suited for containing the cylindrical blower fan.

In many prior art blower housings, the end walls are substantially planar around their peripheral edges. The sidewall is connected to the peripheral edges of the end walls by folded over seams formed at the opposite lateral edges of the sidewall. A portion of each sidewall seam engages against a peripheral portion of the interior surface of each end wall, and the seam is folded over the peripheral edge of the end wall so that a second portion of the seam overlaps and engages against a peripheral portion of the exterior surface of the end wall. The two portions of the seam overlapping the peripheral portions of the interior and exterior surfaces of the end wall are crimped along the peripheral edge of the end wall, thereby attaching the sidewall between the two end walls. In variants of this construction, screws are inserted through the folded seam portions or spot welds are provided along the seams to securely attach the sidewall between the two blower housing end walls.

The above described prior art construction of blower housings has been found to be disadvantaged in that in crimping the seams between the sidewall and end walls of the blower housing, the end walls of the blower housing are at times deformed during the crimping process. Moreover, the prior art seam connections between the sidewall and end walls of the blower housing will vibrate loose over a period of use of the blower housing and will produce squeaks due to relative movement between the sidewall and the end walls at the seam. Spot welds and screws have been employed along prior art seams connecting the sidewall and end walls of blower housings to prevent the seams from vibrating loose and producing squeaks. However, the use of spot welds or screws along the seams increases the expense involved in producing the blower housings. Furthermore, in blower housing constructions where the sidewall and end walls have been painted prior to their assembly, the use of spot welds along the seams connecting the sidewall to the end walls is difficult to weld and leaves weld marks along the seams that detract from the appearance of the painted blower housings.

What is needed to overcome these disadvantages associated with prior art blower housings is an improved seam construction that does not deform the housing end walls and that does not require spot welds or screws to prevent relative movement between the sidewall and end walls, thereby reducing the costs involved in producing the blower housing and enabling the blower housing to be constructed from a coated sidewall and end walls.

SUMMARY OF THE INVENTION

The present invention provides an improved blower housing constructed with improved seams joining a sidewall and a pair of end walls of the blower housing without the need for spot welds or screws along the seam. The present invention also provides the novel method of forming the improved seams between the blower housing sidewall and end walls.

In the blower housing of the present invention, first and second end walls, each having a general planar surface extending adjacent their peripheral edges and each having a rim extending around at least a portion of their peripheral edges, are joined along their rims to a sidewall of the housing by the seam of the invention produced according to the method of the invention. In constructing the seam, the end walls of the blower housing are positioned adjacent each other. The sidewall of the blower housing is positioned extending around the peripheral edges of the two end walls and spacing the two end walls laterally from each other. Flanges formed along opposite lateral edges of the sidewall are positioned adjacent the rims formed along the peripheral edges of the two end walls. The flanges formed at the opposite lateral edges of the sidewall are folded and crimped over the rims of the two end walls so that the flanges overlap opposite sides of the end wall rims, thereby forming seams joining the sidewall between the rims of the two end walls without deforming the rims or the end walls.

The seam of the invention is formed according to the method of the invention in several embodiments, with each embodiment of the seam being formed with a crease or fold extending along the length of the seam. The crease divides each seam into a first seam section adjacent the peripheral edge of the end wall planar surfaces, and a second seam section adjacent the terminal edge of the seam and oriented at an angle to the first seam section. The combination of the overlapping engagement of the sidewall flange over the rims of the two end walls and the creases formed in the seams formed between the sidewall and two end walls produce improved seams joining the sidewall between the laterally spaced end walls of the blower housing that resist relative movement between the sidewall and two end walls during operation of the blower without the need for spot welds or screws along the seams.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENT

Figure 1:
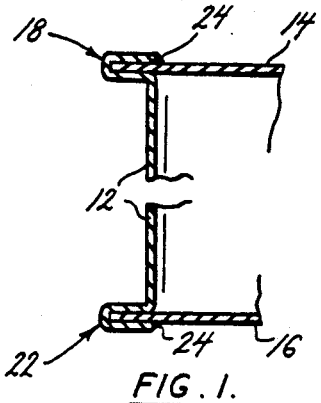
FIG. 1. (PRIOR ART)
FIG. 1 is a partial view, in section, of a prior art blower housing seam.

FIG. 1 shows a partial cross section through the sidewall 12 and two end walls 14, 16 of a prior art blower housing of the type over which the present invention is an improvement. As seen in FIG. 1, in prior art blower housings the housing is constructed by connecting the sidewall 12 between the laterally spaced end walls 14, 16 by seams 18, 22 connecting the opposite lateral edges of the sidewall to the peripheral edges of the two end walls. The seams 18, 22 are formed by folding the opposite lateral edges of the sidewall 12 over portions of the interior and exterior surfaces of the end walls 14, 16 around the peripheral edges of the end walls. The folded edges of the sidewall are crimped over the peripheral edges of the end walls to form the seams 18, 22, and then are secured to the end walls by threaded fasteners (not shown) or spot welds 24 provided at intervals along the seams.

The above described method of constructing the seams 18, 22 connecting the sidewall 12 to the blower housing end walls 14, 16 has been found to be disadvantaged in that the need for providing spot welds 24 or screws along the seams to prevent the folded lateral edges of the sidewall 12 from separating from the peripheral edges of the end walls 14, 16 increases the costs involved in constructing the prior art blower housings. Furthermore, where the sidewall 12 and blower housing end walls 14, 16 have been coated, such as by prepainting, galvanizing or aluminizing, securing the sidewall 12 to the two end walls 14, 16 with spot welds 24 is difficult to weld and leaves weld marks on the coated surfaces of the sidewall and end walls that detract from the appearance of the blower housing.

Figure 2:
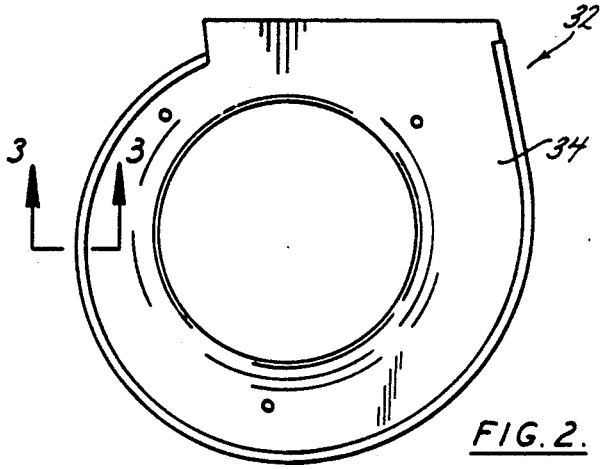
FIG. 2 is a plan view of a blower housing employing the seam of the present invention.

To overcome these and other disadvantages associated with prior art blower housings and their construction, the present invention provides an improved blower housing 32 employing the novel seam of the present invention that is constructed according to the novel method of the present invention. FIG. 2 of the drawing figures shows the improved blower housing 32 of the present invention. In general, the blower housing 32 is constructed from a pair of end walls 34, 36 and a sidewall 38 connected between the two end walls. Each of the housing end walls 34, 36 has a general circular configuration as seen in FIG. 2, with bent rims extending around at least a portion of the circumference of each end wall. The sidewall 38 has the general configuration of a flat strip formed in the shape of a cylinder that extends around the peripheral edges of the two end walls 34, 36 when connected between the rims of the two end walls. The sidewall 38 has folded flanges formed along its opposite lateral edges that connect the opposite lateral edges to the rims of the two end walls 34, 36.

In the first embodiment of the invention, the rims extending around the peripheral edges of the blower housing end walls 34, 36 are formed in two sections. Along the peripheral edges of the two end walls 34, 36, first bends 42, 44 connect the peripheral edges of the end walls to the first sections 46, 48 of the rims. The bends 42, 44 position the first rim sections 46, 48 projecting laterally from the peripheral edges of the two end walls. Second bends 52, 54 are formed at the distal lateral ends of the rim first sections 46, 48 and connect the first sections to second sections 56, 58 of the rims. The second rim bends 52, 54 position the second rim sections 56, 58 projecting in a radial direction relative to the housing end walls 34, 36.

The folded flanges connecting the opposite lateral edges of the sidewall 38 to the rims along the peripheral edges of the end walls 34, 36 are formed in three sections. First folds 62, 64 formed at the opposite lateral edges of the sidewall 38 connect the first flange sections 66, 68 to the sidewall. The first folds 62, 64 position the first flange sections 66, 68 projecting radially outward from the exterior surface of the sidewall 38. Second folds 72, 74 connect the second flange sections 76, 78 to the radially distal ends of the first flange sections 66, 68. The second folds 72, 74 have a general U-shaped configuration and position the second flange sections 76, 78 projecting radially inward, back toward the centers of the blower housing end walls 34, 36, and in laterally spaced and substantially parallel orientations relative to the first flange sections 66, 68. Third folds 82, 84 connect the third flange sections 86, 88 to the second flange sections 76, 78. The third folds 82, 84 position the third flange sections 86, 88 projecting laterally inward toward the center of the sidewall 38 and generally transverse to the orientations of the first and second flange sections.

Figure 3:
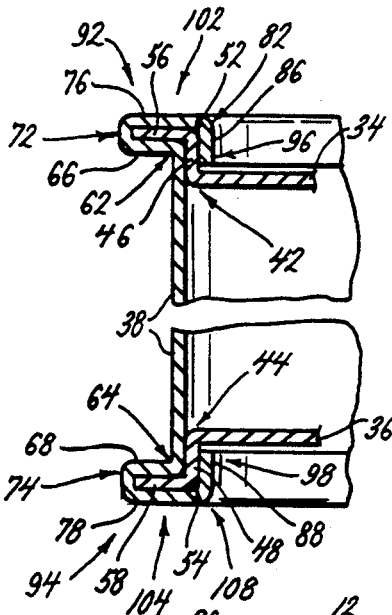
FIG. 3 is a partial view, in section, of the seam of the present invention taken along the line 3—3 of FIG. 2.

The three flange sections formed in the folded flanges at the opposite lateral edges of the sidewall 38 overlap the opposite sides of the end wall rims in forming the seams 92, 94 of the present invention. The configurations of the rims of the two end walls and the configurations of the flanges at the opposite edges of the sidewall produce the seams 92, 94 of the present invention where the seams are formed in two sections separated by a crease formed in the seams. As seen in FIG. 3, the seams 92, 94 are formed with first sections 96, 98 projecting laterally from the peripheral edges of the blower housing end walls 34, 36, and second sections 102, 104 projecting radially from the first seam sections 96, 98. The first and second seam sections are separated by creases 106, 108 formed in the seams that position the seam sections at their relative angular orientations. The formation of the seams 92, 94 with the first seam sections 96, 98 projecting laterally from the blower housing end walls 34, 36, and the second seam sections 102, 104 projecting radially from the distal lateral ends of the first seam sections, provides connections between the blower housing sidewall 38 and the blower housing end walls 34, 36 that will not loosen due to vibrations over a period of use of the blower housing and securely holds the sidewall 38 to the end walls 34, 36 without the need for spot welds or screws.

Figure 4:
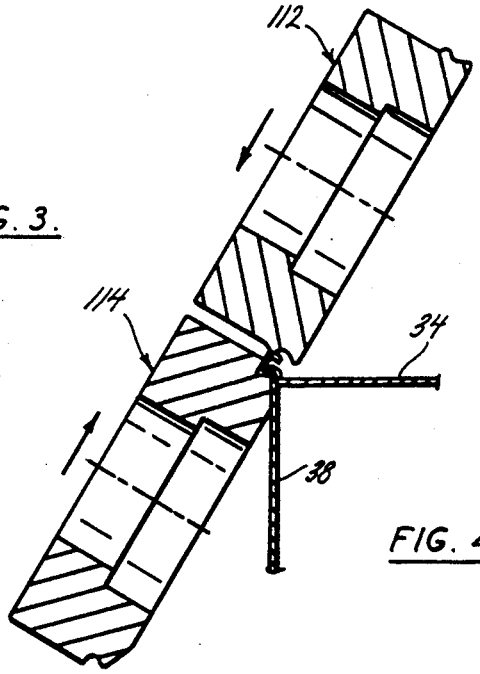
FIG. 4 is a partial view, in section, of a step employed in forming the seam of the present invention.
Figure 5:
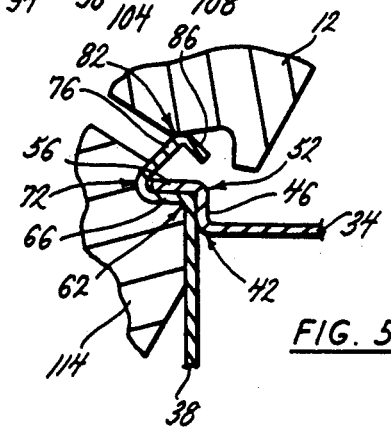
FIG. 5 is a partial view, in section, of a step employed in forming the seam of the present invention.
Figure 6:
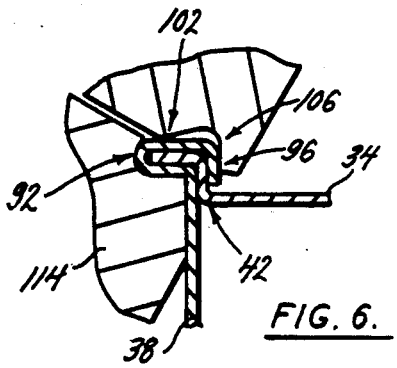
FIG. 6 is a partial view, in section, of a step employed in forming the seam of the present invention.

FIGS. 4–6 show the method employed in forming the seams 92, 94 of the present invention. The seams formed between the opposite lateral edges of the sidewall 38 and the peripheral edges of the two end walls 34, 36 are both formed according to the same method and therefore the formation of only one of the two seams is shown in FIGS. 4–6. In forming the seam 92 of the present invention, the rim is first formed along the peripheral edge of the blower housing end wall 34 with the first section of the rim 46 projecting laterally outward from the end wall peripheral edge, and the second section of the rim 56 projecting radially from the first rim section. The folded flange formed at the lateral edge of the housing sidewall 38 is formed with the first flange section 66 projecting radially from the exterior surface of the sidewall 38, the second flange section 76 projecting at about a 45° angle relative to the first flange section 66, and the third flange section 86 projecting at about a 90° angle relative to the second flange section 76.

The end wall 34 and sidewall 38 are positioned relative to each other as shown in FIG. 5 with the first fold 62 of the folded flange inside the second bend 52 of the rim. The first rim section 46 engages against a portion of the interior surface of the sidewall 38 adjacent the first fold 62, and the second rim section 56 engages against the first flange section 66 of the sidewall on the opposite side of the first fold 62 from the first rim section 46.

The sidewall folded flange and end wall rim are then positioned between a pair of rollers 112, 114 having surface configurations specifically adapted to engage with the three flange sections 66, 76, 86 of the sidewall flange. With the sidewall flange and the end wall rim positioned between the rollers 112, 114 in the positions shown in FIG. 5, the rollers are then moved toward each other causing the surface configurations of the rollers to bend the second and third flange sections 76, 86 over the second and first rim sections 56, 46 of the end wall rim, respectively, as shown in FIG. 6. The movement of the rollers toward each other causing the second and third flange sections 76, 86 to fold at the second flange fold 72 over the second and first rim sections 56, 46 produces the seam of the present invention.

In the relative positions of the two rollers 112, 114 and the sidewall flange and end wall rim shown in FIG. 6, the rollers are then rolled against each other crimping the seam of the present invention between the blower housing sidewall 38 and end wall 34 around the periphery of the blower housing end wall. When the rollers 112, 114 have rolled and formed the seam of the invention around the peripheral edge of the end wall 34, the rollers are moved from the end wall 34 and sidewall 38, now connected by the seam of the present invention. From the overlapping configurations of the sidewall flange and end wall rim shown in FIG. 3, it can be seen that the seam of the present invention, formed with the crease 106 extending along the seam, will prevent relative movement between the sidewall 38 and end wall 34 due to vibration forces or other forces without the need for spot welds or screws along the seam. In this manner, the seam 92 of the present invention provides an improved connection between the blower housing sidewall 38 and end wall 34 that is less expensive to produce than prior art seams employing spot welds or screws and does not detract from the appearance of a coated sidewall and end wall joined by the seam.

Figure 7:
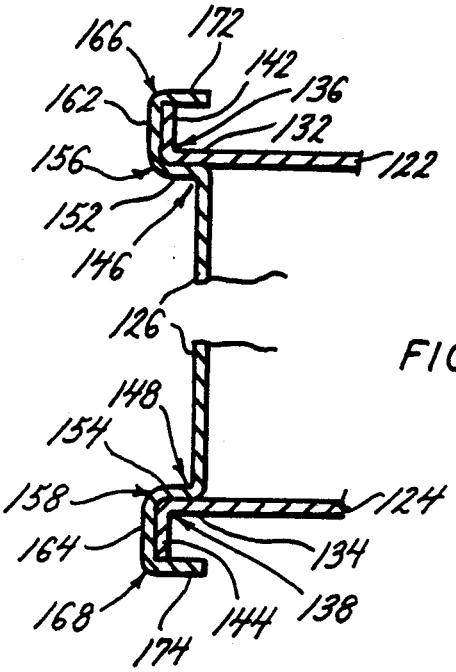
FIG. 7 is a partial view, in section, of a step employed in forming an additional embodiment of the seam of the present invention.
Figure 8:
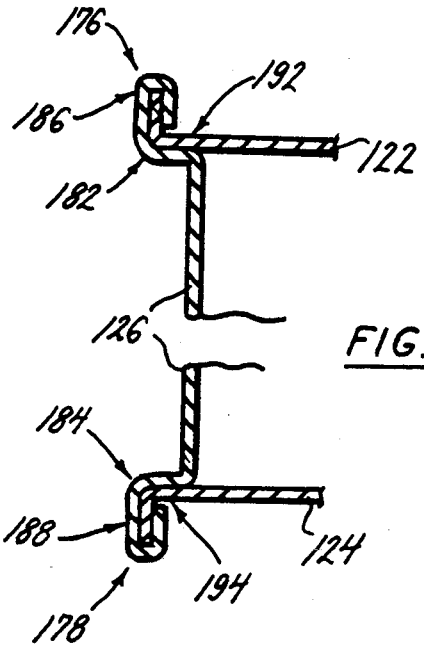
FIG. 8 is a partial view, in section, of a step employed in forming an additional embodiment of the seam of the present invention.

FIGS. 7 and 8 show an additional embodiment of the seam of the present invention. Like the first embodiment of the invention, the second embodiment of the seam shown in FIGS. 7 and 8 is also formed between a rim formed around the peripheral edge of the blower housing end walls 122, 124 and folded flanges formed along the opposite lateral edges of the blower housing sidewall 126.

The second embodiment of the rims at the peripheral edges of the housing end walls 122, 124 are also formed in two sections. However, unlike the first embodiment of the invention, the first section of the rims is not separated from the housing end walls 122, 124 by a bend formed in the periphery of the end walls. The first rim sections 132, 134 are portions of the housing end walls 122, 124 that project from and extend along the peripheral edges of the end walls. As seen in FIG. 7, the first rim sections 132, 134 are formed as radial extensions of the housing end walls 122, 124. Bends 136, 138 are formed at the radial distal ends of the first rim sections and connect the second rim sections 142, 144 to the radial ends of the first rim sections 132, 134. The bends 136, 138 position the second rim sections 142, 144 projecting laterally from the radial edges of the first rim sections 132, 134.

The folded flanges formed along the opposite lateral edges of the sidewall 126 are formed with three flange sections as in the first embodiment of the invention. However, the relative positions of the three flange sections are not the same as those of the first embodiment. At the opposite lateral edges of the sidewall 126, first folds 146, 148 connect the first flange sections 152, 154 to the sidewall 126. The first folds 146, 148 position the first flange sections 152, 154 projecting radially outward from the opposite lateral edges of the sidewall. Second folds 156, 158 connect the second flange sections 162, 164 to the distal radial edges of the first flange sections 152, 154. The second folds 156, 158 position the second flange sections 162, 164 projecting laterally outward from the distal radial edges of the first flange sections 152, 154. Third folds 166, 168 connect the third flange sections 172, 174 to the distal lateral edges of the second flange sections 162, 164. The third folds 166, 168 position the third flange sections 172, 174 projecting radially inward from the distal lateral edges of the second flanges sections 162, 164.

In forming the second embodiment of the seam of the present invention, the blower housing sidewall 126 with the folded flanges formed along its opposite lateral edges, is assembled to the blower end walls 122, 124, with the rims formed along the peripheral edges of the end walls, in the relative positions shown in FIG. 7. In the positions of the sidewall flanges and end wall rims shown in FIG. 7, the first flange sections 152, 154 are positioned adjacent the first rim sections 132, 134 and the second flange sections 162, 164 are positioned adjacent the second rim sections 142, 144. In forming the second embodiment of the seam, the third flange sections 172, 174 are folded over the opposite sides of the second rim sections 142, 144 to enclose the second rim sections between the second and third flange sections. In folding the third flange sections 172, 174 over the second rim sections 142, 144, the third folds 166, 168 of the folded flanges are given a U-shaped configuration extending around the distal lateral edges of the second rim sections 142, 144. The folded flanges are crimped over the rims of the end walls in the positions shown in FIG. 8 by a pair of rollers, as was done in the first embodiment of the invention, to produce the second embodiment of the seam of the present invention joining the sidewall 126 to the two end walls 122, 124. As seen in FIG. 8, the seams 176, 178 are formed in two sections separated by creases 182, 184 formed in the seams. In this embodiment of the invention, the first seam sections 186, 188 project laterally outward from the creases 182, 184 formed in the seams, and the second seam sections 192, 194 extend radially outward from the peripheral edges of the end walls 122, 124 and the lateral edges of the sidewall 126. As in the first embodiment of the invention, the improved seams 176, 178 formed with the first seam sections 186, 188 separated by a crease 182, 184 from the second seam sections 192, 194 securely connect the sidewall 126 to the end walls 122, 124 in a manner that resists the seam connections from vibrating loose over a period of use of the blower housing without the need for spot welds or screws.

Figure 9:
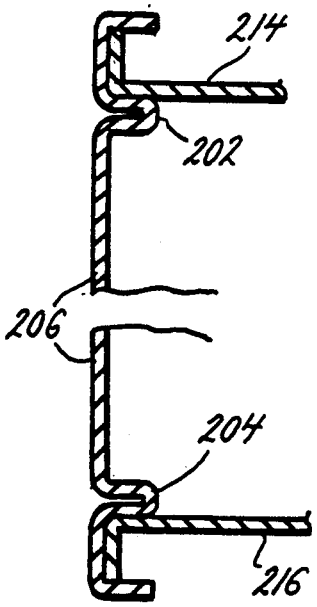
FIG. 9 is a partial view, in section, of a step employed in forming an additional embodiment of the seam of the present invention.
Figure 10:
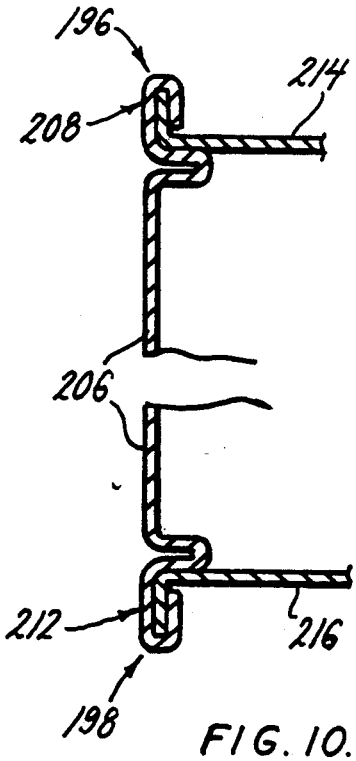
FIG. 10 is a partial view, in section, of a step employed in forming an additional embodiment of the seam of the present invention.

A further embodiment of the seams of the present invention is disclosed in FIGS. 9 and 10. The embodiment of the seams 196, 198 of the present invention shown in FIGS. 9 and 10 is substantially identical to the seams 176, 178 shown in FIGS. 7 and 8 except for additional folds 202, 204 formed at the opposite lateral edges of the sidewall 206. The additional folds 202, 204 in the flanges position the sidewall in the same plane as the first seam sections 208, 212. The provision of the additional folds 202, 204 at the opposite lateral edges of the sidewall 206, and their positioning of the sidewall 206 in the same plane as the first seam sections 208, 212, is for appearance purposes only and does not improve the connection provided by the seams 196, 198 between the sidewall 206 and the blower housing end walls 214, 216.

While the present invention has been described by reference to specific embodiments, it should be understood that modifications and variations of the invention may be constructed without departing from the scope of the invention defined in the following claims.

What is claimed is:

1. A blower housing comprising:

first and second laterally spaced end walls, each end wall having a substantially planar exterior surface and a rim extending around a peripheral edge of the exterior surface;

a sidewall connected between the first and second end walls and laterally spacing the end walls from each other, the sidewall having folded flanges extending along opposite lateral edges of the sidewall;

the folded flanges of the sidewall being connected to the rims of the first and second end walls thereby forming seams between the sidewall and the first and second end walls, the seams extending around the peripheral edges of the first and second end walls and each seam having two sections, the first seam sections extending laterally relative to the exterior surfaces of the end walls and the second seam sections extending radially from the first seam sections;

each rim of the first and second end walls is formed with two sections with a first section of the rim extending laterally from the peripheral edges of the end wall and the second section of the rim extending radially from the first rim section; and, the folded flanges on the opposite lateral edges of the sidewall are each folded over one of the rims of the first and second end walls and overlap the rims on opposite sides of both the first and second rim sections.

2. A blower housing comprising:

first and second laterally spaced end walls, each end wall having a substantially planar exterior surface and a rim extending around a peripheral edge of the exterior surface;

a sidewall connected between the first and second end walls and laterally spacing the end walls from each other, the sidewall having folded flanges extending along opposite lateral edges of the sidewall;

the folded flanges of the sidewall being connected to the rims of the first and second end walls thereby forming seams between the sidewall and the first and second end walls, the seams extending around the peripheral edges of the first and second end walls and each seam having two sections, the first seam sections extending laterally relative to the exterior surfaces of the end walls and the second seam sections extending radially from the first seam sections;

each rim of the first and second end walls is formed with two sections with a first section of the rim extending laterally from the peripheral edge of the end wall and the second section of the rim extending radially from the first rim section; and, the first seam section of each seam is formed by the first rim section of each wall overlapped on opposite sides by a bolded flange of the sidewall.

3. The blower housing of claim 2, wherein:

the second seam section of each seam is formed by the second rim section of each end wall overlapped on opposite sides by a folded flange of the sidewall.

4. The blower housing of claim 2, wherein:

the first rim section of each rim is connected to the peripheral edge of an end wall by a first bend, the first bend positioning the first rim section projecting laterally out from the exterior surface of the end wall, and the second rim section of each rim is connected to a first rim section by a second bend, the second bend positioning the second rim section projecting radially out from the peripheral edge of the end wall.

5. The blower housing of claim 4, wherein:

each folded flange has a first flange section connected to the sidewall by a first fold, the first fold positioning the first flange section projecting radially from an exterior surface of the sidewall, a second flange section connected to the first flange section by a second fold, the second fold positioning the second flange section laterally spaced from and projecting substantially parallel to the first flange section, and a third flange section connected to the second flange section by a third fold, the third fold positioning the third flange section projecting laterally across the first and second flange sections.

6. The blower housing of claim 5, wherein:

the first fold and the third fold of each folded flange are positioned on opposite sides of the first bend of each rim.

7. The blower housing of claim 5, wherein:

the first and second flange sections of each folded flange are positioned on opposite sides of the second rim section of one rim.

8. The blower housing of claim 5, wherein:

the third flange section of each folded flange and a portion of an interior surface of the sidewall are positioned on opposite sides of the first rim section of each rim.

9. The blower housing of claim 5, wherein:

the first and second flange sections and the second fold of each flange together have a general U-shaped configuration and the second rim section of each rim is received in the U-shaped configuration.

10. A blower housing comprising:

first and second laterally spaced end walls, each end wall having a substantially planar exterior surface and a rim extending around a peripheral edge of the exterior surface;

a sidewall connected between the first and second end walls and laterally spacing the end walls from each other, the sidewall having folded flanges extending along opposite lateral edges of the sidewall;

the folded flanges of the sidewall being connected to the rims of the first and second end walls thereby forming seam between the sidewall and the first and second end walls, the seams extending around the peripheral edges of the first and second end walls and each seam having two sections, the first seam sections extending laterally relative to the exterior surfaces of the end walls and the second seam sections extending radially from the first seam sections;

each rim of the first and second end walls is formed with two sections with a first section of the rim being a radial extension of the peripheral edge of the end wall and the second section of the rim extending laterally from the first rim section; and, the folded flanges on the opposite lateral edges of the sidewall are each folded over one of the rims of the first and second end walls and overlap the rims on opposite sides of the second rim section and on at least one side of the first rim section.

11. A blower housing comprising:

first and second laterally spaced end walls, each end wall having a substantially planar exterior surface and a rim extending around a peripheral edge of the exterior surface;

a sidewall connected between the first and second end walls and laterally spacing the end walls from each other, the sidewall having folded flanges extending along opposite lateral edges of the sidewall;

the folded flanges of the sidewall being connected to the rims of the first and second end walls thereby forming seams between the sidewall and the first and second end walls, the seams extending around the peripheral edges of the first and second end walls and each seam having two sections, the first seam sections extending laterally relative to the exterior surfaces of the end walls and the second seam sections extending radially from the first seam sections;

each rim of the first and second end walls is formed with two sections with a first section of the rim being a radial extension of the peripheral edge of the end wall and the second section of the rim extending laterally from the first rim section; and, the first seam section of each seam is formed by the second rim section of each end wall overlapped on opposite sides by a folded flange of the sidewall.

12. The blower housing of claim 11, wherein:

the second seam section of each seam is formed by the first rim section of each end wall overlapped on at least one side by a folded flange of the sidewall.

13. A blower housing comprising:

first and second laterally spaced end walls, each end wall having a substantially planar exterior surface and a rim extending around a peripheral edge of the exterior surface;

a sidewall connected between the first and second end walls and laterally spacing the end walls from each other, the sidewall having folded flanges extending along opposite lateral edges of the sidewall;

the folded flanges of the sidewall being connected to the rims of the first and second end walls thereby forming seams between the sidewall and the first and second end walls, the seams extending around the peripheral edges of the first and second end walls and each seam having two sections, the first seam sections extending laterally relative to the exterior surface of the end walls and the second seam sections extending radially from the first seam sections;

the rims of the first and second end walls are formed with two sections, first sections of the rims are connected to the peripheral edges of the end walls and are radial extensions of the end walls, and the second sections of the rims are connected to the first rim sections by bends, the bends positioning the second rim sections projecting laterally outward from the first rim sections; and, the folded flanges of the sidewall have first flange sections connected to the sidewall by first folds, the first folds positioning the first flange sections projecting radially from an exterior surface of the sidewall, second flange sections connected to the first flange sections by second folds, the second folds positioning the second flange sections projecting laterally from the first flange sections, and third flange sections connected to the second flange sections by third folds, the third folds positioning the third flange sections radially spaced from and projecting substantially parallel to the second flange sections.

14. The blower housing of claim 13, wherein:

the second and third flange sections of each flange are positioned on opposite sides of the second rim section of one rim.

15. The blower housing of claim 13, wherein:

the second and third flange sections and the third fold of each flange together have a general U-shaped configuration and the second rim section of one rim is received in the U-shaped configuration.

16. A blower housing comprising:

first and second laterally spaced end walls, each end wall having opposite, generally planar, interior and exterior surfaces and a rim extending around at least a portion of a circumference of the end wall, the rim having a first section connected to the circumference of the end wall by a first bend, the first bend positioning the first rim section projecting laterally out from the circumference of the end wall, and the rim having a second section connected to the first rim section by a second bend, the second bend positioning the second rim section projecting radially out from the circumference of the end wall; and a sidewall connected between the first and second end walls and laterally spacing the first and second end walls from each other, the side wall having opposite interior and exterior surfaces and laterally spaced, folded flanges extending along opposite lateral edges of the sidewall surfaces, the folded flanges connecting the sidewall to the rims of the first and second end walls.

17. The blower housing of claim 16, wherein:

the folded flanges overlap over opposite sides of the first and second rim sections of the end walls.

18. The blower housing of claim 16, wherein:

portions of the sidewall interior surface adjacent the folded flanges engage against the first rim sections of the end walls.

19. The blower housing of claim 16, wherein:

each folded flange has a first flange section connected to the sidewall by a first fold, the first fold positioning the first flange section projecting radially from the exterior surface of the sidewall; a second flange section connected to the first flange section by a second fold, the second fold positioning the second flange section laterally spaced from and projecting generally parallel to the first flange section; and a third flange section connected to the second flange section by a third fold, the third fold positioning the third flange section projecting laterally across the first and second flange sections.

20. The blower housing of claim 19, wherein:

the first fold and the third fold of each folded flange are positioned on opposite sides of the first bend of each end wall rim.

21. The blower housing of claim 19, wherein:

the first and second flange sections of each folded flange are positioned on opposite sides of the second rim section of each end wall rim.

22. The blower housing of claim 19, wherein:

the third flange section of each folded flange and a portion of the sidewall interior surface adjacent each folded flange are positioned on opposite sides of the first rim section of each end wall rim.

23. The blower housing of claim 19, wherein:

the first and second flange sections and the second fold of each flange together have a U-shaped configuration and the second rim section of each rim is received in the U-shaped configuration.

24. A method of constructing a blower housing from a pair of end walls and a sidewall, each end wall having opposite, generally planar, interior and exterior surfaces and a rim extending around at least a portion of a peripheral edge of the end wall, and the sidewall having folded flanges extending along opposite lateral edges of the sidewall, the method comprising:

forming the rim of each end wall in two sections, with a first section of the rim being connected to the peripheral edge of the end wall by a first bend, the first bend positioning the first rim section projecting laterally from the exterior surface of the end wall, and with a second section of the rim being connected to the first rim section by a second bend, the second bend position the second rim section projecting radially out from the peripheral edge of the end wall;

connecting the sidewall between the pair of end walls and laterally spacing the end walls from each other by folding the folded flanges of the sidewall over the rims of the pair of end walls without deforming the first and second sections or the first and second bends of both rims; and, folding the folded flanges over the rims of the end walls by overlapping the first and second rim sections of each end wall with the folded flanges.

25. The method of claim 24, further comprising:

folding each of the folded flanges into three flange sections, with a first flange section connected to the sidewall by a first fold that positions the first flange section projecting radially from an exterior surface of the sidewall and extending against one side of the second section of each rim, a second flange section connected to the first flange section by a second fold that positions the second flange section laterally spaced from the first flange section and projecting generally parallel to the first flange section and extending against a second side of the second section of each rim opposite the one side of the rim second section, and a third flange section connected to the second flange section by a third fold that positions the third flange section projecting laterally across the first and second flange sections and against the first section of each rim.

26. A method of constructing a blower housing from a pair of end walls and a sidewall, each end wall having opposite, generally planar interior and exterior surfaces and a rim extending around at least a portion of a periphery of the end wall, and the sidewall having folded flanges extending along opposite lateral edges of the sidewall, the method comprising:

forming the rims of the end walls in two sections, with first sections of the rims being formed as peripheral extensions of the end walls, and second sections of the rims being formed connected to the first rim sections by bends, with the bends positioning the second rim sections projecting laterally outward from the first rim sections; and connecting the sidewall between the pair of end walls by folding the folded flanges of the sidewall over the rims of the pair of end walls without deforming the first and second sections or the bends of the rims.

27. The method of claim 26, further comprising:

folding the folded flanges over the rims of the end walls by overlapping the second rim sections of each end wall with the folded flanges.

28. The method of claim 28, further comprising:

folding each of the folded flanges into three flange sections, with first flange sections connected to the sidewall by first folds that position the first flange sections projecting radially from an exterior surface of the sidewall and extending against the first rim sections of the rims, with second flange sections connected to the first flange sections by second folds that position the second flange sections projecting laterally from the first flange sections and extending against one side of the second rim sections, and with third flange sections connected to the second flange sections by third folds that position the third flange sections radially spaced from and projecting substantially parallel to the second flange sections and extending against a second side of the second rim sections.

* * * * *